US007264239B2

(12) United States Patent
Kawai

(10) Patent No.: US 7,264,239 B2
(45) Date of Patent: Sep. 4, 2007

(54) FEEDING DEVICE FOR FEEDING RECORDING MEDIUM

(75) Inventor: Takamitsu Kawai, Oobu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/806,174

(22) Filed: Mar. 23, 2004

(65) Prior Publication Data

US 2004/0190972 A1 Sep. 30, 2004

(30) Foreign Application Priority Data

Mar. 26, 2003 (JP) ..... 2003-084795

(51) Int. Cl.
*B65H 29/70* (2006.01)

(52) U.S. Cl. ..... 271/188; 271/272; 271/274; 271/314; 400/636; 347/104; 347/218; 347/262; 347/264

(58) Field of Classification Search ..... 271/188, 271/272, 314, 274; 400/636; 347/218, 104, 347/262, 264
See application file for complete search history.

(56) References Cited

U.S. PATENT DOCUMENTS 4,231,562 A * 11/1980 Hori ..... 271/3.04
5,291,224 A * 3/1994 Asano et al. ..... 346/134
5,480,130 A * 1/1996 Suzuki et al. ..... 270/58.11
5,606,357 A * 2/1997 Bekki ..... 347/104
5,653,439 A * 8/1997 Rider et al. ..... 271/274
5,669,724 A 9/1997 Kato
5,897,259 A * 4/1999 Ahn ..... 400/629
5,961,234 A * 10/1999 Uchikata ..... 400/636
6,254,078 B1 * 7/2001 Taruki ..... 271/3.01
6,305,684 B1 * 10/2001 Lightner et al. ..... 271/122
6,325,560 B1 * 12/2001 Hirabayashi et al. ..... 400/636
6,712,463 B2 * 3/2004 Matsumoto ..... 347/104

FOREIGN PATENT DOCUMENTS

JP 57072538 A * 5/1982
JP A 6-15898 1/1994
JP 09086749 A * 3/1997
JP A 9-86749 3/1997
JP A 9-136470 5/1997
JP Y2 2563146 11/1997
JP A 10-67148 3/1998
JP A 2000-335801 12/2000

* cited by examiner

*Primary Examiner*—Gene O. Crawford
*Assistant Examiner*—Leslie A Nicholson, III
(74) *Attorney, Agent, or Firm*—Oliff & Berridge, PLC

(57) ABSTRACT

A feeding device for feeding a recording medium in a feed direction, including: a drive roller having an annular recess; and a driven roller rotatably held and positioned such that a radially outer end portion of the driven roller is positioned within the annular recess of the drive roller. The driven roller is displaceable away from the drive roller, so that the recording medium is fed to pass between the drive and driven rollers, with the recording medium being gripped by the radially outer end portion of the driven roller and the radially outer end portion of the drive roller. The feeding device further includes an overlap-amount limiter including a contact portion which is positioned within the annular recess and which is, during absence of the recording medium between the drive and driven rollers, held in contact at its surface with the radially outer end portion of the driven roller, for thereby limiting an overlap amount by which the radially outer end portion of the driven roller overlaps with the radially outer end portion of the drive roller.

18 Claims, 12 Drawing Sheets

FIG.4A
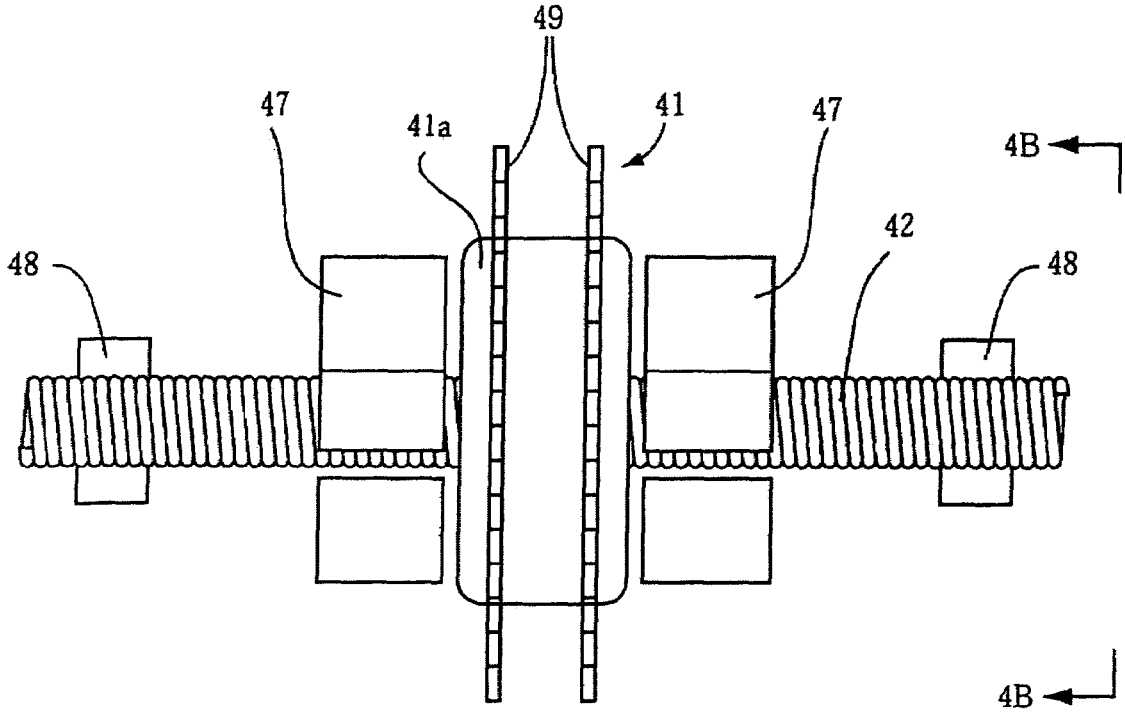
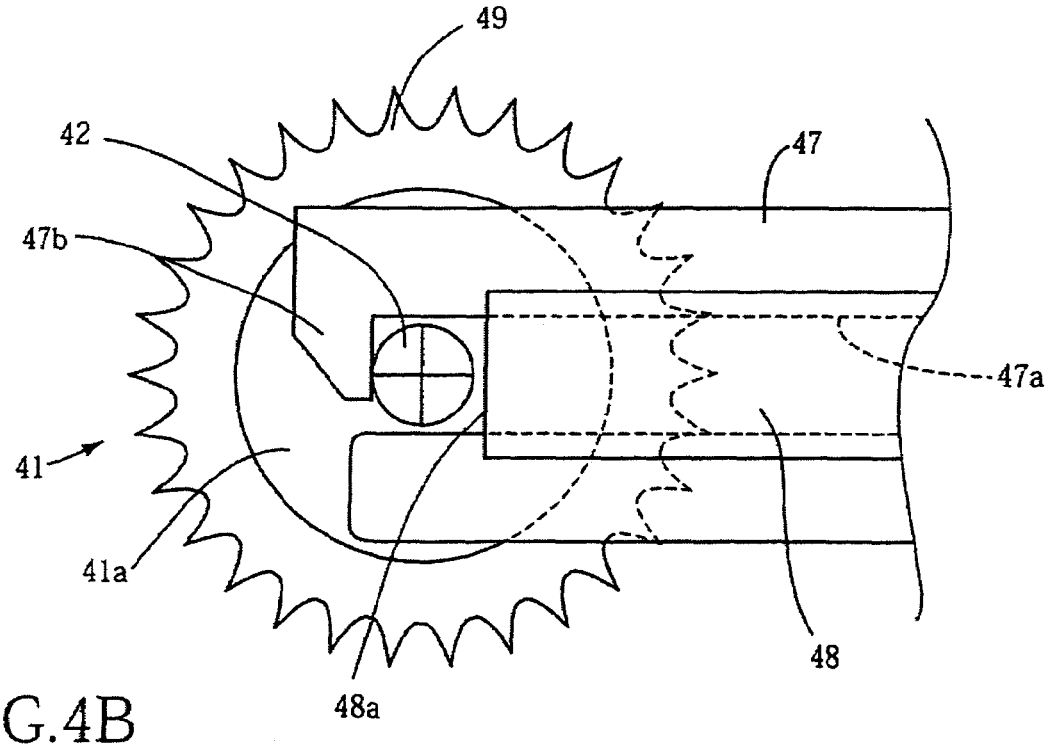
FIG.4B

PRIOR ART

FEEDING DEVICE FOR FEEDING RECORDING MEDIUM

This application is based on Japanese Patent Application No. 2003-84795 filed in Mar. 26, 2003, the content of which is incorporated hereinto by reference.

BACKGROUND OF THE INVENTION

1. Field of the Invention

The present invention relates in general to a feeding device for feeding a paper sheet or other recording medium on which desired patterns of images or characters are printed by an inkjet print head.

2. Discussion of Related Art

As a feeding device for feeding a paper sheet in an inkjet printer, there is known a device including (a) a drive roller which is disposed on a downstream side of a recording portion of an inkjet print head as viewed in a feed direction of the paper sheet, and (b) a driven roller which is opposed to the drive, roller, so that the drive and driven rollers operate with each other to grip the paper sheet and feed the paper sheet in the feed direction. The driven roller is provided by a gear-like or toothed roller which has a plurality of radially-extending projections formed on a circumference of the roller. The paper sheet can be fed in a predetermined feed direction while being gripped by and between the drive roller and the driven roller which is forced toward the drive roller, after an ink has been ejected onto the medium so as to form an image on the medium. In this instance, even if the ink has not yet being dried, the ink does not adhere to the circumference of the driven roller, owing to the radially extending projections of the driven roller.

Such a known feeding device further includes a drive mechanism which is disposed on an upstream side of the recording portion. The drive mechanism serves to feed the paper sheet from a media supply portion to a printing-start position. When the paper sheet reaches the printing-start position, a printing operation is initiated by successive reciprocating motions of the recording portion in a primary scanning direction (perpendicular to the above-described feed direction). The paper sheet having reached the printing-start position is intermittently fed in the feed direction (corresponding to a secondary scanning direction) by a predetermined distance per each feed motion That is, after each of the successive reciprocating motions of the recording portion, the paper sheet is fed toward the drive roller disposed on the downstream side of the recording portion, while a desired pattern of image is being printed on the paper sheet. When a leading end of the paper sheet reaches the drive roller, the paper sheet enters between the drive and driven rollers. The printing operation is continued while the paper sheet is gripped by and between the rollers. After a trailing end of the paper sheet has passed through the drive mechanism disposed on the upstream side of the recording portion, the paper sheet is fed to a media exit portion, by only the drive and driven rollers cooperating to grip the paper sheet.

Generally, the drive roller is made of a rubber or metallic material. In some cases, the drive roller is covered at its surface with a coating layer which is made of a material having a high degree of coefficient of friction. On the other hand, the driven roller is made of a resin or metallic material. Since the driven roller is forced toward the drive roller, the rollers are in contact with each other during absence the paper sheet between the rollers, thereby problematically causing scratch of the drive roller or its coating layer and wear of the driven roller.

For solving such a conventional problem, there is proposed an arrangement, as disclosed in JP-A-H09-86749 (publication of unexamined Japanese Patent Application), which avoids the contact of the drive and driven rollers with each other. FIG. 12 shows the disclosed arrangement in which an annular groove 43 is formed in an outer circumferential surface of a drive roller 40 which is disposed on a downstream side of the recording portion as viewed in a feed direction of the paper sheet P (indicated by two-dot chain line in FIG. 12). A driven roller 41 is rotatably held by a flexible shaft 42 such that a radially outer end 45 of the driven roller 41 is positioned within the annular groove 43 of the drive roller 40, so that radially outer end portions of the respective rollers 40, 41 intersects or overlaps with each other. When the paper sheet reaches the driven roller 41, the driven roller 41 is forced by a leading end of the paper sheet P to be displaced, against an elastic force generated by the flexible shaft 42, in the upward direction, i.e., in a direction away from the drive roller 40, for thereby permitting the paper sheet P to enter between the drive and driven rollers 40, 41 and to be gripped by and between the radially outer ends 44, 45 of the respective rollers 40, 41. In this arrangement in which the radially outer end 46 of the driven roller 41 is positioned within the, annular groove 43 of the drive roller 41, the rollers 40, 41 are not brought into contact with each other even during absence of the paper sheet P between the rollers 40, 41. The arrangement thus frees the rollers 40, 41 from being undesirably scratched or worn.

In the above-described feeding device or arrangement, after the trailing end of the paper sheet is disengaged from the drive mechanism disposed on the upstream side of the recording portion, the paper sheet is fed to the exit portion, by the grip engagement of the paper sheet and the rollers. For reliably and accurately feeding the paper sheet, the driven roller has to be forced by a predetermined amount of pressing force, onto the paper sheet against the drive roller.

In the arrangement disclosed in JP-A-H09-86749, during absence of the paper sheet P between the rollers 40, 41, the radially outer end 45 of the driven roller 41 is positioned within the annular groove 43 of the drive roller 40, without the radially outer end 45 being in contact with a bottom surface of the groove 43. In this instance, since the rollers 40, 41 are not in contact with the each other, the flexible shaft 42 holding the driven roller 41 does not receive any load, or is slightly flexed downwardly due to weight of the driven roller 41. During presence of the paper sheet between the rollers 40, 41, the flexible shaft 42 is flexed upwardly as a result of the upward displacement of the driven roller 41. In this instance, a restoring force or spring load generated by the flexed flexible shaft 42 acts on the driven roller 41, whereby driven roller 41 is forced onto the paper sheet P.

Therefore, in the arrangement of JP-A-H09-86749, for reliably and accurately feeding the paper sheet P, an amount of the intersection or overlap of the radially outer end portions of the respective rollers 40, 41 has to be sufficiently large, so that the flexible shaft 42 is upwardly flexed by an amount required for obtaining the predetermined amount of pressing force during presence of the paper sheet P between the rollers 40, 41. It is noted that the intersection or overlap amount can be represented by a distance L1 (as indicated in FIG. 12) between the radially outer end 45 of the driven roller 41 and the radially outer end 44 of the drive roller 40.

However, in this arrangement, upon entrance of the paper sheet P between the rollers 40, 41, the leading end of the paper sheet P has to force the driven roller 41 to be raised against the elastic force of the flexible shaft 42 by at least the distance L1. This means that an increase in the above-described overlap amount leads to an increase in force resisting the paper sheet P upon its entrance between the rollers 40, 41. The increase in the resistance force is likely to cause deflection of the paper sheet P and undesirable variation in the distance by which the paper sheet P is fed per each of the successive feed motions, thereby resulting in positional error of the printing spot and other deterioration in the printing quality. Particularly, where the printing operation is carried out by an inkjet printer, namely, where the operation is made with a high value of image resolution, the printing quality could be considerably affected by the variation in the feed distance even if an amount of the variation is small

SUMMARY OF THE INVENTION

The present invention was made in view of the background prior art discussed above. It is therefore an object of the present invention to provide a feeding device in which the recording medium can be introduced between the drive and driven rollers without a large force resistant to the recording medium, and can be gripped by and between the drive and driven rollers with a sufficiently large force, so that a printing operation can be achieved without deterioration in the printing quality. This object may be achieved according to any one of first through thirteenth aspects of the invention which are described below.

The first aspect of the invention provides a feeding device for feeding a recording medium in a feed direction, comprising: (a) a drive roller having an annular recess formed in an outer circumferential surface thereof; and (b) a driven roller rotatably held and positioned relative to said drive roller such that a radially outer end portion of said driven roller is positioned within said annular recess of said drive roller so that said radially outer end portion of said driven roller overlaps with a radially outer end portion of said drive roller. The driven roller is displaceable at least in a direction away from said drive roller, so that the recording medium is fed to pass between said drive roller and said driven roller, with the recording medium being gripped by said radially outer end portion of said driven roller and said radially outer end portion of said drive roller. The feeding device further comprising: (c) an overlap-amount limiter including a contact portion which is positioned within said annular recess, more specifically described, within a portion of the annular recess in which the radially outer end portions of the rollers overlap with each other. During absence of the recording medium between said driven roller and said drive roller, the contact portion of the overlap-amount limiter is held in contact at a surface thereof with said radially outer end portion of said driven roller, for thereby limiting an overlap amount by which said radially outer end portion of said driven roller overlaps with said radially outer end portion of said drive roller.

In the present feeding device, upon entrance of the recording medium between the drive and driven rollers, the recording medium displaces the driven roller in the direction away from the drive roller, so as to mount on the outer circumferential surface of the drive roller. A distance between axes of the respective rollers and the above-described overlap amount are predetermined based on an appropriate amount of pressing force that is to act on the recording medium gripped by and between the rollers. The driven roller is positioned relative to the drive roller such that the axes of the rollers are distant from each other by the predetermined distance and such that the radially outer end portion of the driven roller is positioned within the annular recess with the predetermined overlap amount. With provision of the overlap-amount limiter which is in contact with the radially outer end portion of the driven roller and limits the overlap amount, the driven roller is displaced by the overlap-amount limiter in the direction away from the drive roller even during absence of the recording medium between the rollers, thereby making it possible to reduce an amount by which the driven roller is to be displaced or raised by the recording medium. Therefore, this arrangement is effective to reduce the resistance which acts on the recording medium upon entrance of the medium between the rollers, thereby avoiding undesirable variation in the feed distance per each feed motion and accordingly assuring a high printing quality.

Owing to the provision of the overlap-amount limiter, the amount by which the driven roller is to be displaced by the recording medium is reduced. It should be noted that this reduction does not affect the pressing force which acts on the recording medium gripped by the rollers. That is, the overlap-amount limiter reduce the resistance which acts on the recording medium upon entrance of the medium between the rollers, but does not reduce the pressing force acts on the medium gripped by the rollers so that the medium can be reliably and accurately fed.

According to the second aspect of the invention, in the feeding device defined in the first aspect of the invention, said contact portion of said overlap-amount limiter is formed of a material which is harder than a material forming said driven roller, thereby making it possible to increase wear resistance of the contact portion of the overlap-amount limiter.

According to the third aspect of the invention, in the feeding device defined in the first or second aspect of the invention, the above-described surface of said contact portion of said overlap-amount limiter is positioned between said outer circumferential surface of said drive roller and a bottom surface of said annular recess of drive roller. In other words, the surface of the contact portion of the overlap-amount limiter is located between an axis of the drive roller and a portion of the outer circumferential surface of the drive roller which portion is in contact with the recording medium during presence of the recording medium between the drive and driven rollers.

According to the fourth aspect of the invention, in the feeding device defined in any one of the first through third aspects of the invention, said driven roller is formed of a resin. This arrangement is effective to reduce weight of the driven roller, and also to prevent the drive roller from being damaged even if the driven roller is brought into contact with the drive roller.

According to the fifth aspect of the invention, in the feeding device defined in any one of the first through fourth aspects of the invention, said overlap-amount limiter includes an annular member which is positioned within said annular recess. In this arrangement, the contact portion, which is to be held in contact at its surface with the radially outer end portion of the driven roller, can be easily positioned within the annular recess of the drive roller, by simply mounting or fitting the annular member as the overlap-amount limiter onto the drive roller. Further, since the annular member can be entirely accommodated within the annular recess of the drive roller, any additional space is not required for the provision of the annular member.

The sixth aspect of the invention provides an image recording apparatus comprising: the feeding device defined in any one of the first through fifth aspects of the invention; a recording portion which records an image on a recording medium and which is disposed on an upstream side of said feeding device as viewed in said feed direction; a platen which is opposed to said recording portion and supports the recording medium; and a media exit portion through which the recording medium exits from said apparatus after the image is recorded on the recording medium by said recording portion. In the present image recording apparatus, the recording portion is activated to record the image on the recording medium supported by the platen, and the recording medium is then fed to the media exit portion by the feeding device. As discussed above, since the feeding device has the arrangement effective to reduce the resistance acting on the recording medium upon entrance of the medium between the rollers, it is possible to feed the medium reliably and accurately, thereby assuring a high printing quality.

According to the seventh aspect of the invention, in the image recording apparatus defined in the sixth aspect of the invention, said overlap-amount limiter includes a tongue member extending in said feed direction and having a distal end portion as said contact portion positioned within said annular recess in which the radially outer end portions of the rollers overlap with each other. In this arrangement, the tongue member as the overlap-amount limiter is provided by a member independent from the drive roller so that the tongue member is not rotated together with the drive roller. Therefore, even if the tongue member is adapted to be constantly held in contact with the driven roller during absence of the recording medium between the driven and drive rollers, the tongue member and the driven roller are prevented from being easily scratched or worn, thereby improving durability of the apparatus. Further, since the tongue member as the overlap-amount limiter extends from the upstream side of the rollers to the annular recess of the drive roller, the tongue member is capable of serving to guide the recording medium to the radially outer end portion of the driven roller, thereby making it possible to rapidly and accurately introduce the recording medium between the drive and driven rollers.

According to the eighth aspect of the invention, in the image recording apparatus defined in the seventh aspect of the invention, said tongue member extends from said platen. In this arrangement, the recording medium, which has been fed while being held by the platen, can be guided rapidly by the tongue member from the platen to the radially outer end portion of the driven roller.

According to the ninth aspect of the invention, in the image recording apparatus defined in the eighth aspect of the invention, said tongue member is formed integrally with said platen, in other words, the tongue member and at least a part of the platen is provided by a single piece. This arrangement eliminates an operation to attach the tongue member to the platen in a process of manufacturing the image recording apparatus, thereby making it possible to simplify the manufacturing process.

According to the tenth aspect of the invention, in the image recording apparatus defined in the sixth aspect of the invention, said overlap-amount limiter includes a tongue member which extends in a direction opposite to said feed direction and which has a distal end portion as said contact portion which is positioned within said annular recess in which the radially outer end portions of the rollers overlap with each other. In this arrangement, the tongue member as the overlap-amount limiter is provided by a member independent from the drive roller so that the tongue member is not rotated together with the drive roller. Therefore, even if the tongue member is adapted to be constantly held in contact with the driven roller during absence of the recording medium between the driven and drive rollers, the tongue member and the driven roller are prevented from being easily scratched or worn, thereby improving durability of the apparatus.

According to the eleventh aspect of the invention, in the image recording apparatus defined in the tenth aspect of the invention, said tongue member extends from a member which constitutes at least a part of said media exit portion. In this arrangement, the member constituting at least the part of the media exit portion can serve also as a fixing device for fixing the tongue member in a predetermined position, thereby making it possible to save a space required for the installation of the tongue member.

According to the twelfth aspect of the invention, in the image recording apparatus defined in the eleventh aspect of the invention, said tongue member is formed integrally with said member which constitutes at least the part of said media exit portion. This arrangement eliminates an operation to attach the tongue member to the member constituting at least the part of the media exit portion, thereby making it possible to simplify a process of manufacturing the image recording apparatus.

According to the thirteenth aspect of the invention, in the image recording apparatus defined in the eleventh or twelfth aspect of the invention, said member which constitutes at least the part of said media exit portion is provided by a media exit tray which supports the recording medium after the image is recorded on the recording medium by said recording portion. In this arrangement, the media exit tray can serve also as a fixing device for fixing the tongue member in a predetermined position, thereby making it possible to save a space required for the installation of the tongue member.

BRIEF DESCRIPTION OF THE DRAWINGS

The above and other objects features, advantages and technical and industrial significance of the present invention will be better understood by reading the following detailed description of presently preferred embodiment of the invention, when considered in connection with the accompanying drawings, in which:

FIG. 4A is a view of one of the driven rollers as seen in a direction in which the drive and driven rollers are opposed to each other;

FIG. 4B is a view of the drive roller as seen in a direction indicated by arrows 4B in FIG. 4A;

DETAILED DESCRIPTION OF THE PREFERRED EMBODIMENT

Figure 1:
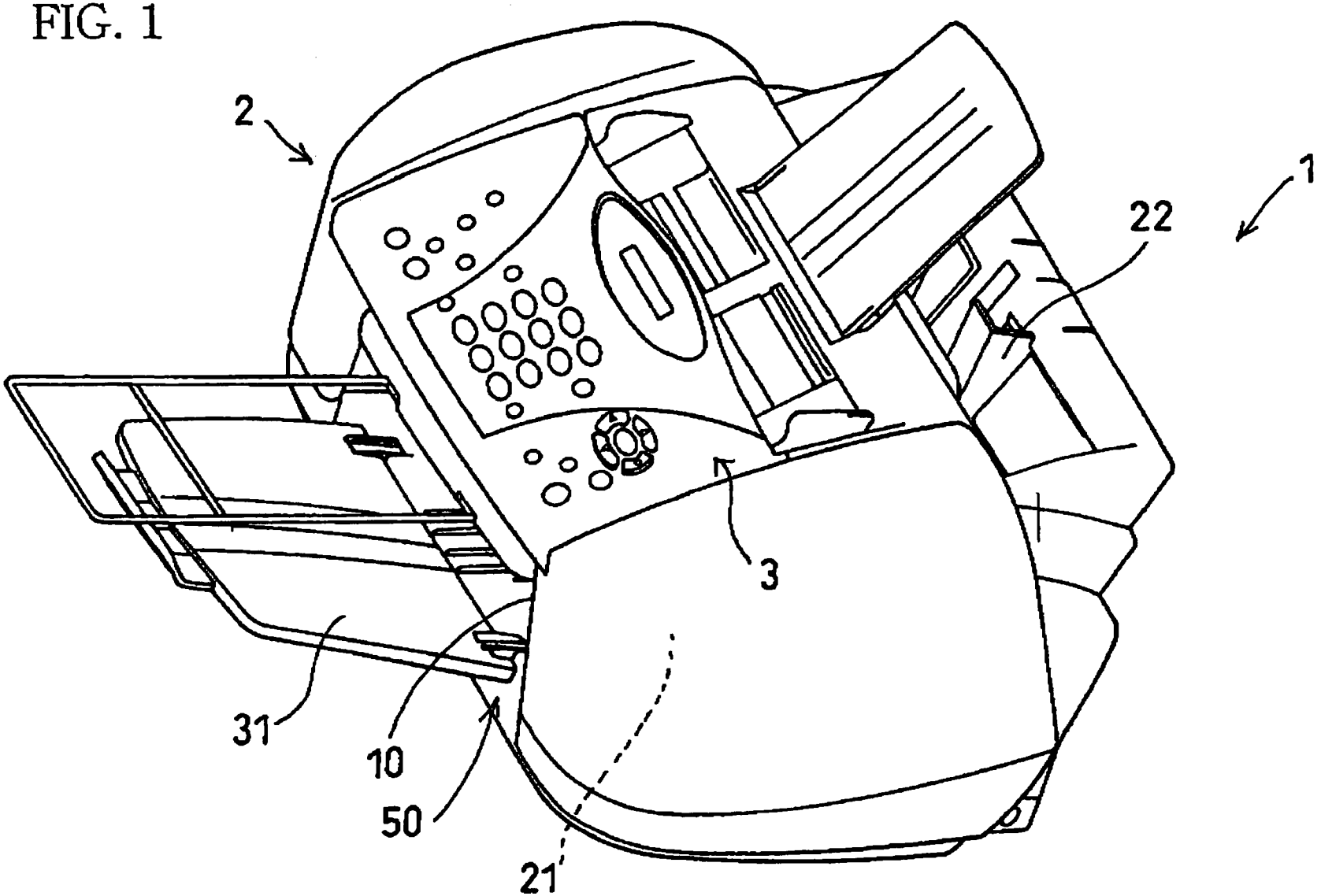
FIG. 1 is a perspective view of a multifunction apparatus equipped with a feeding device which is constructed according to an embodiment of the invention.

FIG. 1 shows a multifunction apparatus (multiplex apparatus) 1 having facsimile, scanner, copier and printer functions. This multifunction apparatus 1 is equipped with a feeding device 10 which is constructed according to an embodiment of the invention.

Figure 2:
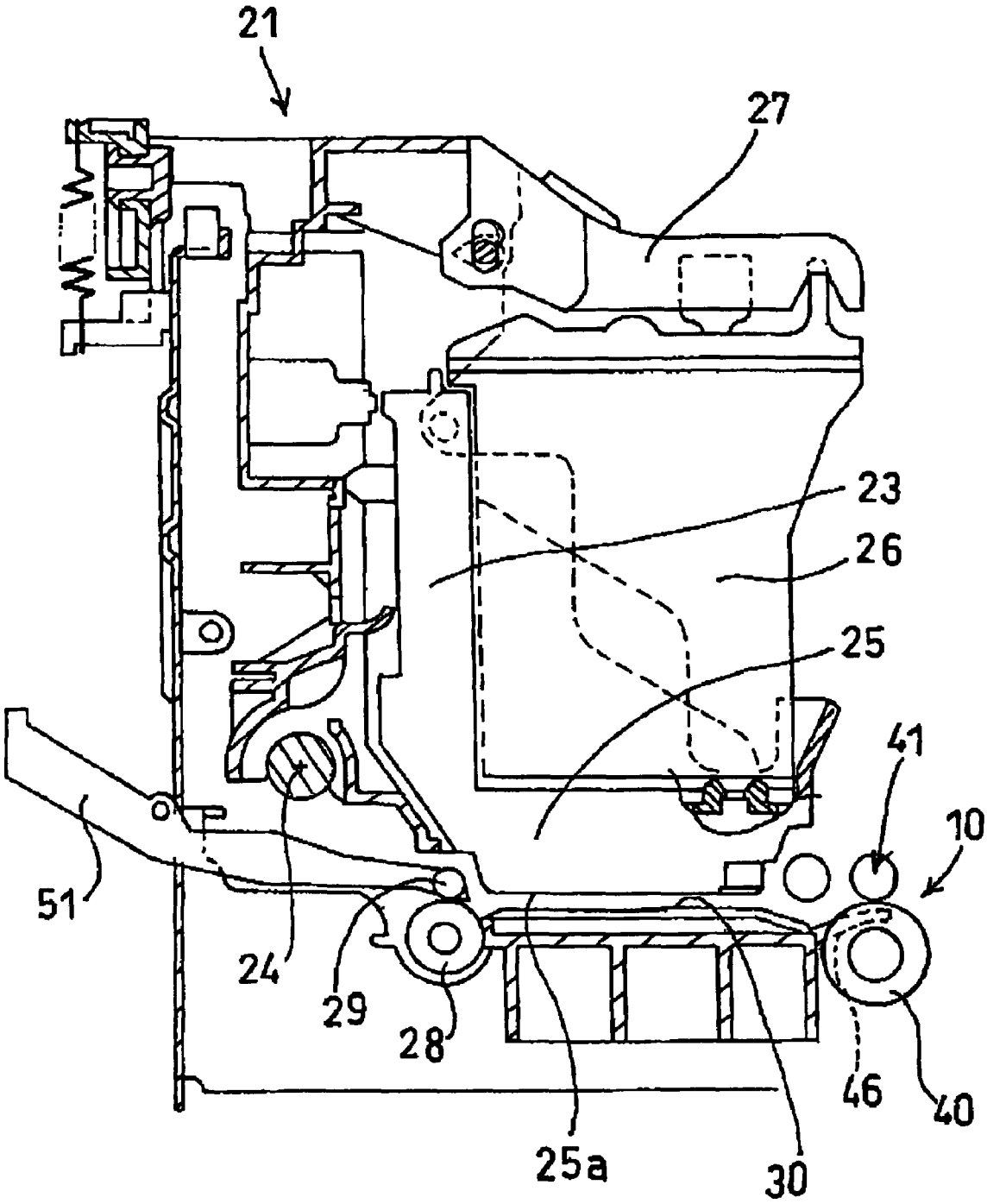
FIG. 2 is a cross sectional view of a main portion of the multifunction apparatus of FIG. 1.

The multifunction apparatus 1 has, on an upper face of its main body 2, an operating panel 3 equipped with an indicator display and various keys such as ten keys and function keys which are manually operable by an operator of the apparatus 1, to input various command signals for various operations (e.g., facsimileing, scanning and copying operations) to be performed by the apparatus 1. The apparatus 1 further has a media supply tray 22 and a media exit tray 31 located on back and front sides of the main body 2, respectively. In an operation with the apparatus 1, a recording medium in the form of a paper sheet P is supplied through the media supply tray 22 so that the paper sheet P is slid on a slant surface of the media supply tray 22, into the main body 2. On a surface of the paper sheet P supplied into the main body 2, a desired pattern of image is printed by a recording unit 21 of an inkjet head, which is built in the main body 2 as shown in FIG. 2. After the desired pattern of image is printed on the surface of the paper sheet P, the paper sheet P is received by the media exit tray 31.

As shown in FIG. 2, the recording unit 21 has a carriage 23 which is slidably and pivotably mounted on a guide shaft 24 provided by a round bar member. On the carriage 23, there is removably mounted a recording head 25 of color-inkjet cartridge type. The recording head 25 has, in its lower face, four recording portions (nozzle portions) 25*a* which are arranged to eject droplets of inks of respective four colors (yellow, magenta, cyan and black colors), for performing a color recording operation. Four ink cartridges 26, filled with the inks of the respective colors, are removably mounted on an upper face of the recording head 25, so that the inks are supplied from the ink cartridges 26 to the recording head 25. A hold lever 27 is provided to be located on an upper side of the carriage 23, and is arranged to be vertically movable. By fort this hold lever 27 downwardly against the ink cartridges 26, the ink cartridges 26 can be fixed relative to the recoding head 25.

The media supply tray 22 is stacked with the recording media in the form of the paper sheets P, which are separated one by one in a known manner with a separating device constituted by, for example, a friction pad or a friction plate. The feeding device 10 of the apparatus 1 is constructed such that each of the paper sheets P is fed in the forward direction (i.e., in the rightward direction as seen in FIG. 2) from the media supply tray 22 into the main body 2 and then exits from the main body 2 through a media exit portion 50.

The feeding device 10 has first drive and driven rollers 28, 29 which are opposed to each other and located on the upstream side of the recording portions 25*a* as viewed in a feed direction of each paper sheet P. By an arm 61 which is held to be inclined such that its rear portion (left portion as seen in FIG. 2) is positioned upwardly of its front portion, the first driven roller 29 is biased toward the first drive roller 28. The paper sheet P supplied from the media supply tray 22 enters between the first drive and driven rollers 28, 29 so as to be gripped by and between the rollers 28, 29, whereby the paper sheet P initiates to be fed by the feeding device 10.

A platen 30 is provided to be located on the downstream side of the first drive and driven rollers 28, 29, so as to be opposed to the recoding head 25, as shown in FIG. 2, so that the paper sheet P passes over the platen 30 after a desired pattern of image is printed on the paper sheet P by activation of the recording portions 25*a* of the recording head 25. The platen 30 extends along a feed path of the paper sheet P, and serves as a bridge between the first rollers 28, 29 and second rollers 40, 41 which are located on the downstream side of the recording portions 26*a*.

The second rollers 40, 41 consist of a second drive roller 40 and a plurality of second driven rollers 41 which are opposed to the second drive roller 40. The paper sheet P is fed to pass between the second drive and driven rollers 40, 41, and is then received by the media exit tray 31. The drive roller 40, driven roller (wheels) 41 and members supporting these rollers 40, 41 cooperate to constitute a media outlet.

Figure 3:
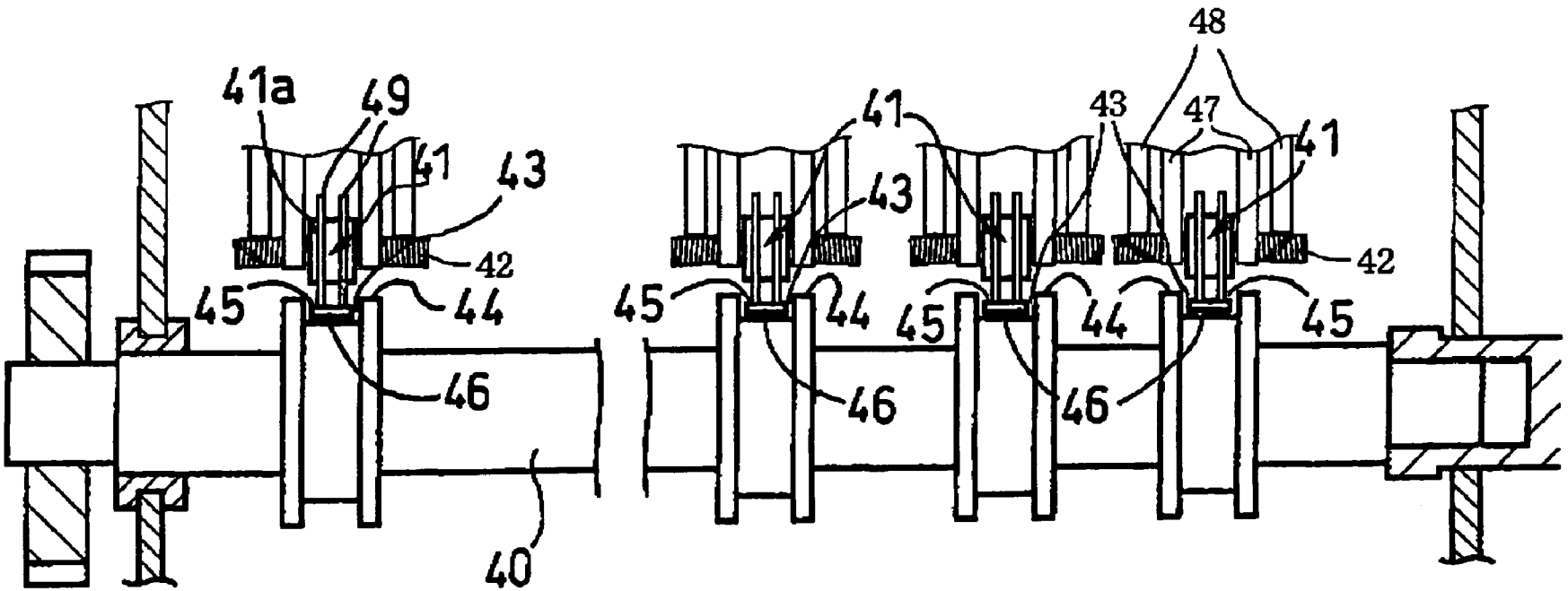
FIG. 3 is a view of drive and driven rollers of the feeding device.

The drive roller 40 has, in its outer circumferential surface, a recess in the form of a plurality of annular grooves 43 which are formed to be axially spaced apart from each other, as shown in FIG. 3. The drive roller 40, made of a metallic material, may be coated with a ceramic material or other material having a high degree of coefficient of friction, or may be knurled or otherwise machined to have a better gripping surface. Further, while the drive roller 40 is made of the metallic material in the present embodiment, the drive roller 40 may be formed of other material such as a rubber.

Figure 6:
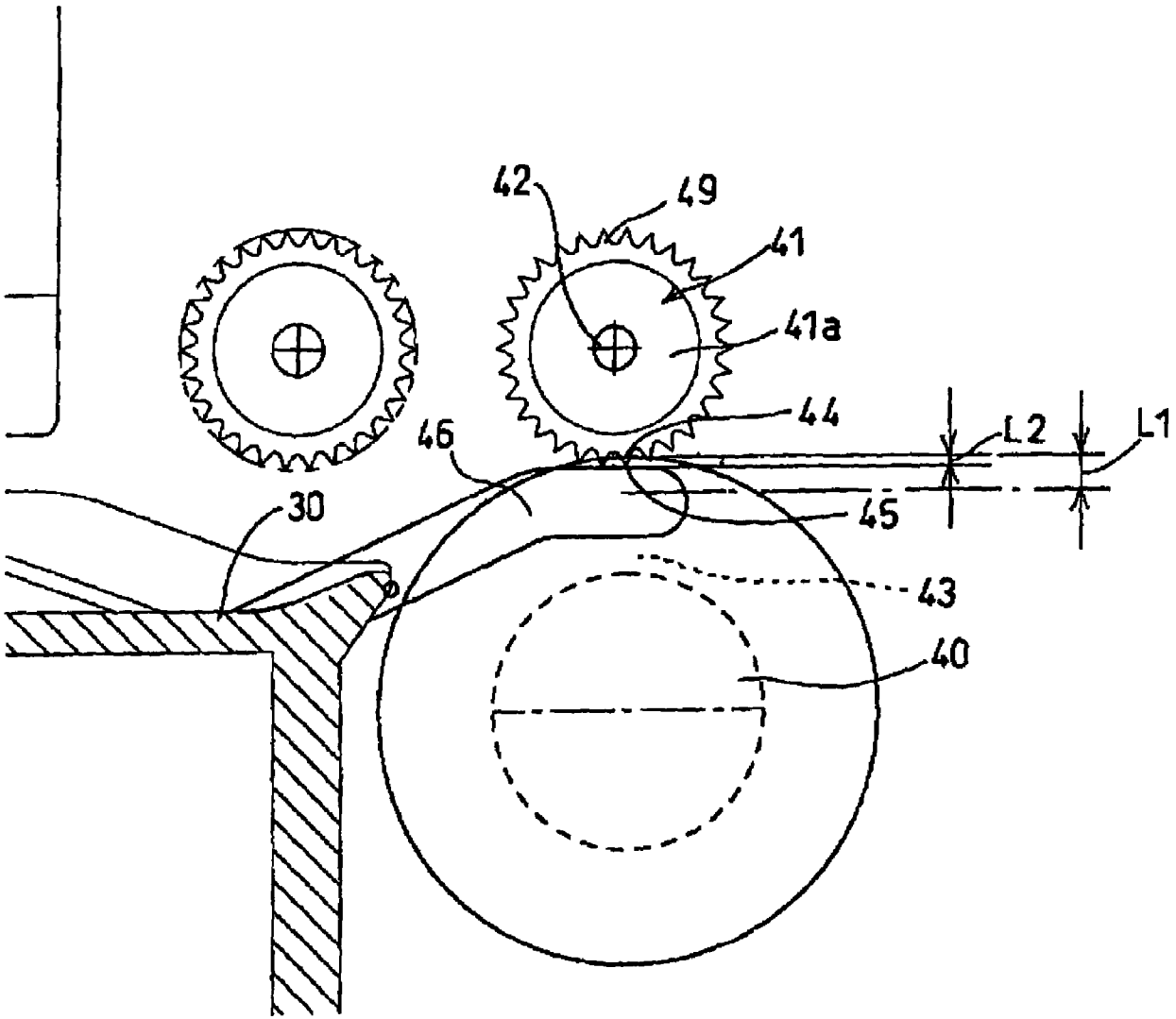
FIG. 6 is a side view of the drive and driven rollers, showing a positional relationship between the drive and driven rollers during absence of a paper sheet as a recording medium between the rollers.

Each of the second driven rollers 41 includes a radially inner core portion 41*a* and a gear-like or toothed radially outer end portion 49 which has a plurality of radially-extending projections, as shown in FIG. 6. The second driven rollers 41 are rotatably held independently of each other, by respective flexible shafts 42 (each provided by a coil spring shaft) which are arranged in series along a straight line, as shown in FIG. 3, and are driven to be rotated following rotation of the second drive roller 40. Each of the second driven rollers 41 is mounted on an axially intermediate portion of a corresponding one of the flexible shafts 42, as shown in FIG. 4A. Each of the flexible shafts 42 is supported by a supporting device in the form of a pair of inside support members 47 and a pair of outside support members 48. The inside and outside support members 47, 48 are provided by respective plate members extending from a holder plate (not shown) which is arranged to be opposed to the second drive roller 40 and which is a part of the main body 2 or is connected to the main body 2. The outside support members 48 have respective distal end surfaces 48*a*, as shown in FIG. 4B, which are to be brought into contact with axially opposite end portions of the flexible shafts 42. That is, the outside support members 48 serve as a displacement limiter for limiting displacement of the axially opposite end portions of the flexible shaft 42 in a direction away from the drive roller 40, i.e., in the rightward direction as seen in FIG. 4B. Each of the inside support members 47 is located between the driven roller 41 and a corresponding one of the outside support members 48, as shown in FIG. 4A. Each inside support member 47 is divided into two parts by an elongated hole or slot 47*a* which is formed in its widthwise central portion and extends in its longitudinal direction, and has an engaging portion 47*b*, in its distal end portion, which projects from one of the above-described divided two parts toward the other part, as shown in FIG. 4B. The axially intermediate portion of the flexible shaft 42 is accommodated in the elongated holes 47*a* of the inside support members 47. The driven roller 41 and the axially intermediate portion of the flexible shaft 42 are allowed, owing to the elongated holes 47*a* of the inside support members 47, to be displaced in the direction away from the drive roller 40. However, their displacement toward the drive roller 40 is limited by the engaging portions 47*b* of the inside support members 47. The driven rollers 41 are positioned relative to the drive roller 40 such that each of the driven rollers 41 is opposed to a corresponding one of the annular grooves 43 of the drive roller 40 and such that a radially outer end 45 of each driven roller 41 is positioned within the corresponding annular groove 43 of the drive roller 40. That is, the toothed radially outer end portion 49 of each driven roller 41 overlaps with a radially outer end portion of the drive roller 40. In the present embodiment, each driven roller 41 is made of a resin such as polyacetal (POM) which preferably contains a waxy opaque material sold under the trademark TEFLON. However, the entirety of each driven roller 41 or only the toothed radially outer end portion 49 may be made of a metallic material such as stainless steel (SUS). Further, while the toothed radially outer end portion 49 is provided by two thin plates which are held in parallel with each other in the present embodiment, the radially outer end portion 49 may be provided by a single plate.

A plurality of tongue members 46 are provided to extend from the platen 30 in a feed direction of the paper sheet P, and have respective distal end portions serving as contact portions which are held in contact wit the radially outer ends 45 of the respective driven rollers 41, as shown in FIG. 6. Each of the tongue members 46 serves as an overlap-amount limiter for limiting an overlap amount by which the radially outer end portion 49 of each driven roller 41 overlaps with the radially outer end portion of the drive roller 40. That is, as a result of the contact of each tongue member 46 with the radially outer end 45 of the corresponding driven roller 41, the driven roller 41 is displaced away from the drive roller 40 whereby the overlap amount is limited to a distance L2 as indicated in FIG. 6. It is noted that the overlap amount can be defined also as an amount obtained by subtracting a distance between axes of the respective drive and driven rollers 40, 41, from a sum of radii of the respective drive and driven rollers 40, 41.

Each flexible shaft 42 supporting the corresponding driven roller 41 is fixed by the above-described inside and outside support members 47, 48 in a position relative to the drive roller 40 such that the overlap amount corresponds to a distance L1 (i.e., the same distance as in the above-described conventional feeding device) if the tongue member 46 as the overlap-amount limiter were absent in the present feeding device 10. This distance L1, larger than the above-described distance L2, is determined on the basis of an amount of spring load required for obtaining a predetermined amount of pressing force. In absence of the tongue member 46, the radially outer end portion 49 of each driven roller 41 overlaps with the radially outer end portion of the drive roller 40 by the distance L1, and the flexible shaft 42 holding the driven roller 41 does not receive any load, or is slightly flexed downwardly due to weight of the driven roller 41. It is noted that each of the annular grooves 43 of the drive roller 40 has a radial depth sufficiently large such that the driven roller 41 is not brought into contact with a bottom surface of each annular groove 43 of the drive roller 41 even in absence of the tongue member 46.

Figure 5:
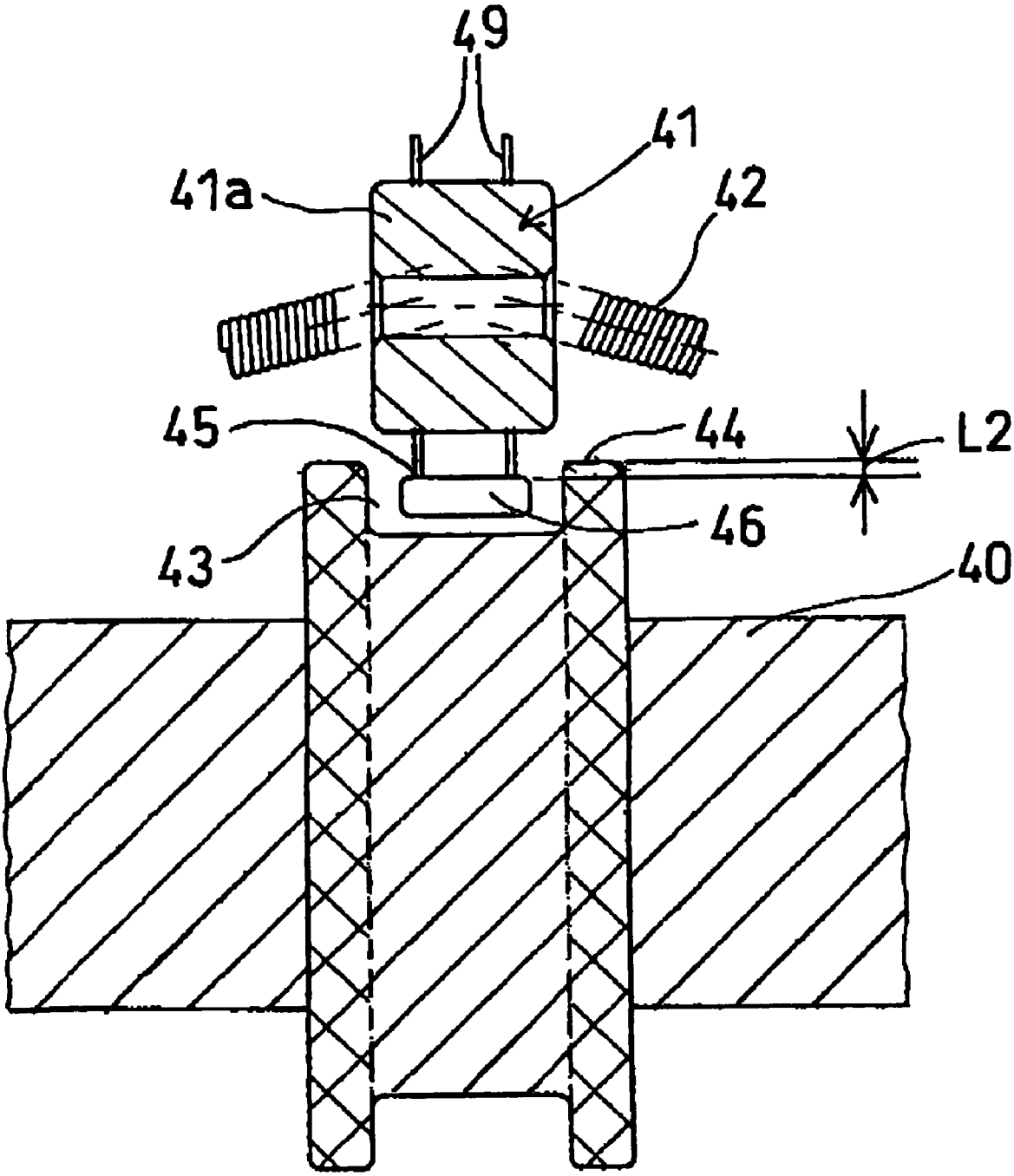
FIG. 5 is a front view of one of the driven rollers and a part of the drive roller.

The overlap amount is reduced to correspond to the distance L2, by the provision of the tongue member 46 as the overlap-amount limiter which is brought into contact with the radially outer end 45 of the driven roller 41. As a result of the reduction of the overlap amount, the flexible shaft 42 on which the driven roller 41 is mounted is flexed upwardly, as shown in FIG. 5, since the driven roller 41 together with the axially intermediate portion of the flexible shaft 42 is raised by the tongue member 46 against the elastic force of the flexible shaft 42, by an amount corresponding to a difference between the distances L1 and L2.

The tongue member 46 as the overlap-amount limiter may be provided by a single piece which is formed of a resin, or alternatively, a hard material such as glass and stainless steel which is harder than the driven roller 41 so as to increase wear resistance of the tongue member 46 against the driven roller 41. Further, the tongue member 46 may be formed of the resin and the hard material, for example, such that the hard material is embedded in a contact surface of the distal end portion at which the tongue member 46 is held in contact with the radially outer end 45 of the driven roller 41, or the hard material has a cap-like shape and is provided to cover the distal end portion while the other portion of the tongue member 46 is formed of the resin.

There will be described an operation of the feeding device 10 which is constructed as described above. Each of he paper sheets P separated one by one from the media supply tray 22 enters between the first drive and driven rollers 28, 29 so as to be gripped by and between the rollers 28, 29. The paper sheet P gripped by the rollers 28, 29 is fed in a feed direction (corresponding to a rightward direction as seen in FIG. 2) by the rollers 28, 29 until a leading end of the paper sheet P reaches a printing-start position Then, the recording portions 25*a* are selectively activated in response to a printing command, so that ink droplets are ejected onto an upper surface of the paper sheet P, whereby a desired pattern of image is printed on the upper surface of the paper sheet P. While the image being printed on the paper sheet P, the paper sheet P is intermittently fed in the feed direction (corresponding to a secondary scanning direction) by a predetermined distance after each of successive reciprocating motions of the recording head 25 in a primary scanning direction (perpendicular to the above-described feed direction or secondary scanning direction), whereby the paper sheet P is fed to pass through a space between the recording head 25 and the platen 30.

When the leading end of the paper sheet P arrives in proximity of the second drive roller 40, the leading end of the paper sheet P is guided by upper surfaces of the tongue members 46 (which extend from the platen 30 in the feed direction), to the radially outer ends 45 of the driven rollers 41 which are held in contact with the distal end portions of the tongue members 46. The leading end of the paper sheet P then raises or upwardly displaces the driven rollers 41 by an amount corresponding to a sum of the distance L2 and a thickness of the paper sheet P, so as to enter between the radially outer end 44 of the drive roller 40 and the radially outer ends 45 of the driven rollers 41. In this instance, the paper sheet P receives, through the driven rollers 41, the spring load generated by a restoring force of the flexible shafts 42 which is based on the displacement of each driven roller 41 by the distance L1 rather than distance L2. In other words, the flexible shafts 42 and the weights of the driven rollers 41 serve as a biaser to bias the driven rollers 41 toward the drive roller 40, so that the paper sheet P is gripped by and between the drive and driven rollers 40, 41. Then, the paper sheet P thus gripped by and between the rollers 40, 41 is fed toward the media exit tray 31, while the printing operation is being effected by the recording portions 25*a* of the recording head 25. The paper sheet P is eventually received by the media exit tray 31, after the printing operation is completed.

In the present feeding device 10 constructed as described above, owing to the presence of the tongue member 46 as the overlap-amount limiter, the driven rollers 41 are raised even during absence of the paper sheet P between the drive and driven rollers 40, 41. Therefore, the amount, by which each driven roller 41 has to be upwardly displaced by the paper sheet P upon entrance of the paper sheet P between the rollers 40, 41, is equal to the distance L2 that is smaller than the distance L1, although the paper sheet P can be gripped by the rollers 40, 41 with a predetermined pressing force (ie., pressing force corresponding to the amount of the distance L1). That is, it is possible to reduce force resisting the paper sheet P upon its entrance between the rollers 40, 41, without reducing the pressing force acting on the paper sheet P after its entrance between the rollers 40, 41. The reduction in the resistance force against the entrance of the paper sheet P between the rollers 40, 41 is effective to avoid deflection of the paper sheet P upon the entrance and undesirable variation in the distance by which the paper sheet P is fed per each of the successive feed motions in the secondary scanning direction, thereby assuring smooth feed motions and resulting in a high printing quality.

Figure 7:
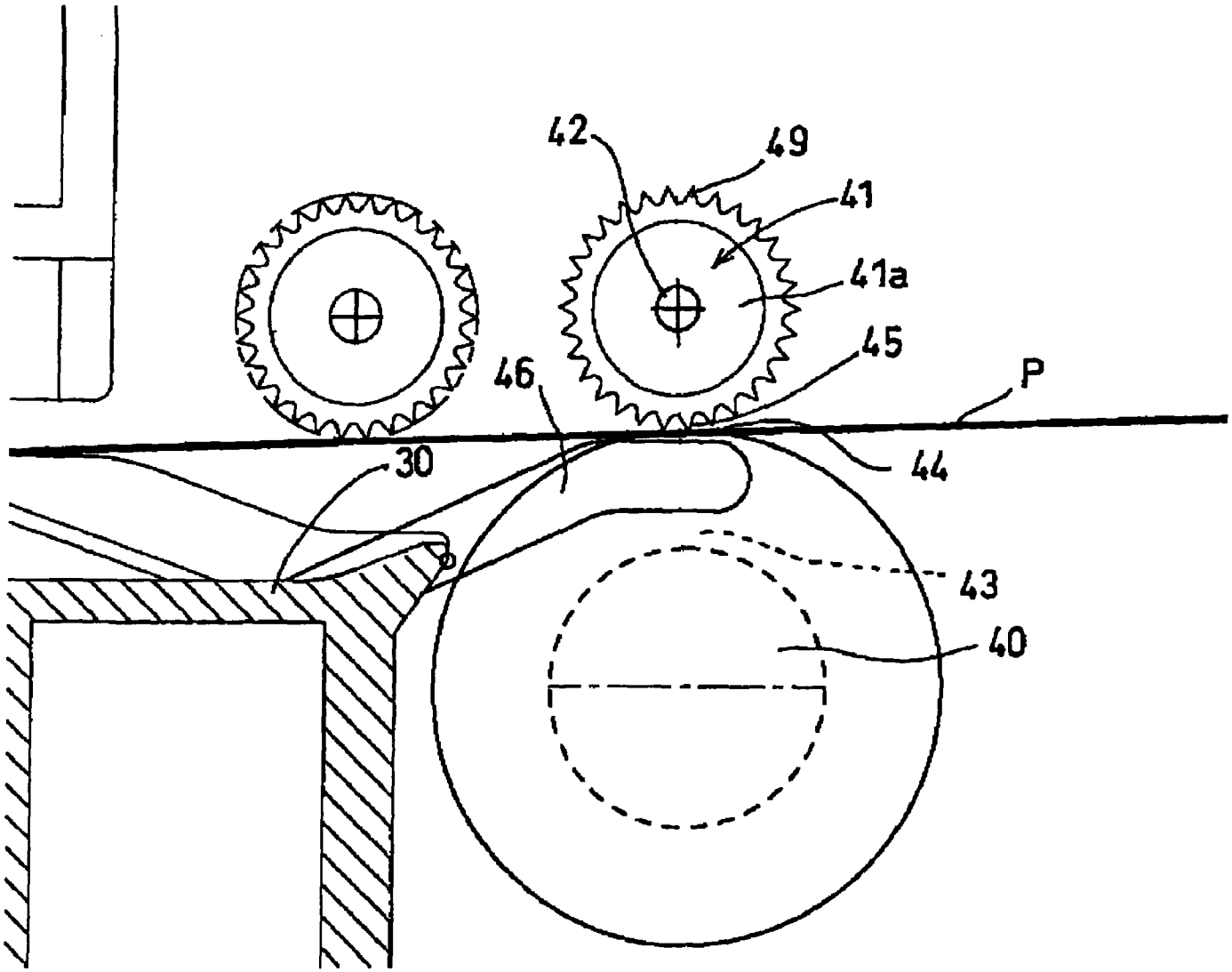
FIG. 7 is a side view of the drive and driven rollers, showing a positional relationship between the drive and driven rollers during presence of the paper sheet between the rollers.
Figure 11:
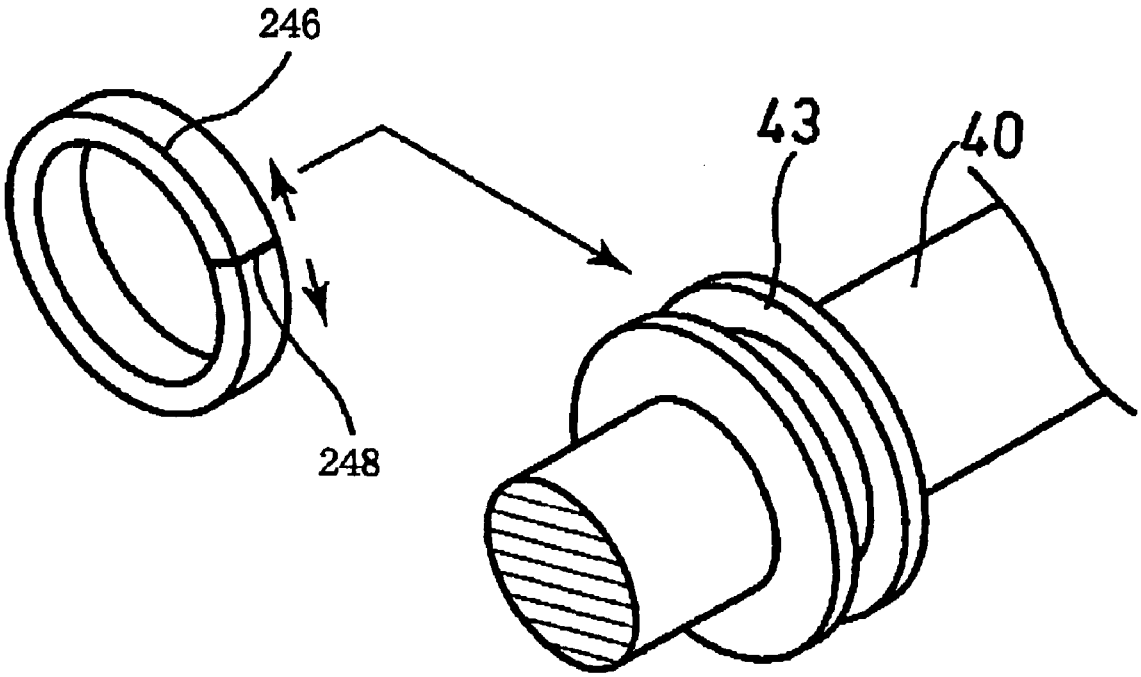
FIG. 11 is a view showing a formation of an annular member as an overlap-amount limiter in the above-described another modified arrangement.

There will be described a specific example of the arrangement of the second drive and driven rollers 40, 41. In this specific example of the arrangement, the driven rollers 41 are positioned relative to the drive roller 40 such that the distance L1 (i.e., the overlap amount in absence of the tongue member 46 as the overlap-amount limiter) is 1.0 mm, while the tongue member 46 is positioned relative to the driven rollers 41 such that the distance L2 (i.e., the overlap amount in presence of the tongue member 46 which upwardly forces the driven rollers 41) is 0.3 mm. In this arrangement, the driven rollers 41 are upwardly forced by the tongue member 46, the driven rollers 41 receive a spring load of 14 gF ($=14\times9.8\times10^{31\ 3}$N. When the paper sheet P is positioned between the drive and driven rollers 40, 41, as shown in FIG. 7, the paper sheet P is gripped by and between the rollers 40, 41 with a pressing force (spring load) of 20 gF. This means that, for enabling the paper sheet P to be gripped with the pressing force of 20 gF, the paper sheet P has to raise each driven roller 41 by an amount as large as 1.0 mm upon its entrance between the rollers 40, 41 in the conventional feeding device, as shown in FIG. 11, in which the tongue member 46 as the overlap-amount limiter is absent. In the present feeding device 10 equipped with tongue member 46, the amount by which each driven roller 41 has to be raised by the paper sheet P is as small as 0.3 mm, since each driven roller 41 is already raised by the tongue member 46 before the paper sheet P enters between the rollers 40, 41.

While the distance L2 is set to be 0.3 mm in the above-described specific example, the distance L2 may be set to be another value which is larger than 0 and smaller than the value of L1 (0<L2<L).

In the above-described embodiment in which the tongue member 46 extends from the platen 30 to the annular groove 48 of the drive roller 40, the tongue member 46 can serve also to guide the leading end of the paper sheet P to the radially outer ends 45 of the driven rollers 41, thereby making it possible to rapidly and accurately introduce the paper sheet P between the drive and driven rollers 40, 41, without the paper sheet P being brought into contact with side faces of the drive and driven rollers 40, 41. It is noted that the tongue member 46 may be provided by a member independent from the platen 30 and attached to the platen 30, or may be formed integrally with the platen 30.

Further, in the above-described embodiment, the tongue member 46 is separated from the drive roller 40, so that the tongue member 46 is neither rotated nor even moved by rotation of the drive roller 40. Therefore, even though the tongue member 46 is arranged to be constantly held in contact with the driven roller 41 (which is not rotated together with the drive roller 40 during absence of the paper sheet P between the rollers 40, 41) during absence of the paper sheet P between the rollers 40, 41, the tongue member 46 and the driven roller 41 are not scratched or worn by their mutual contact, since the tongue member 46 and the driven roller 41 are not moved relative to each other during absence of the paper sheet P between the rollers 40, 41.

Figure 8:
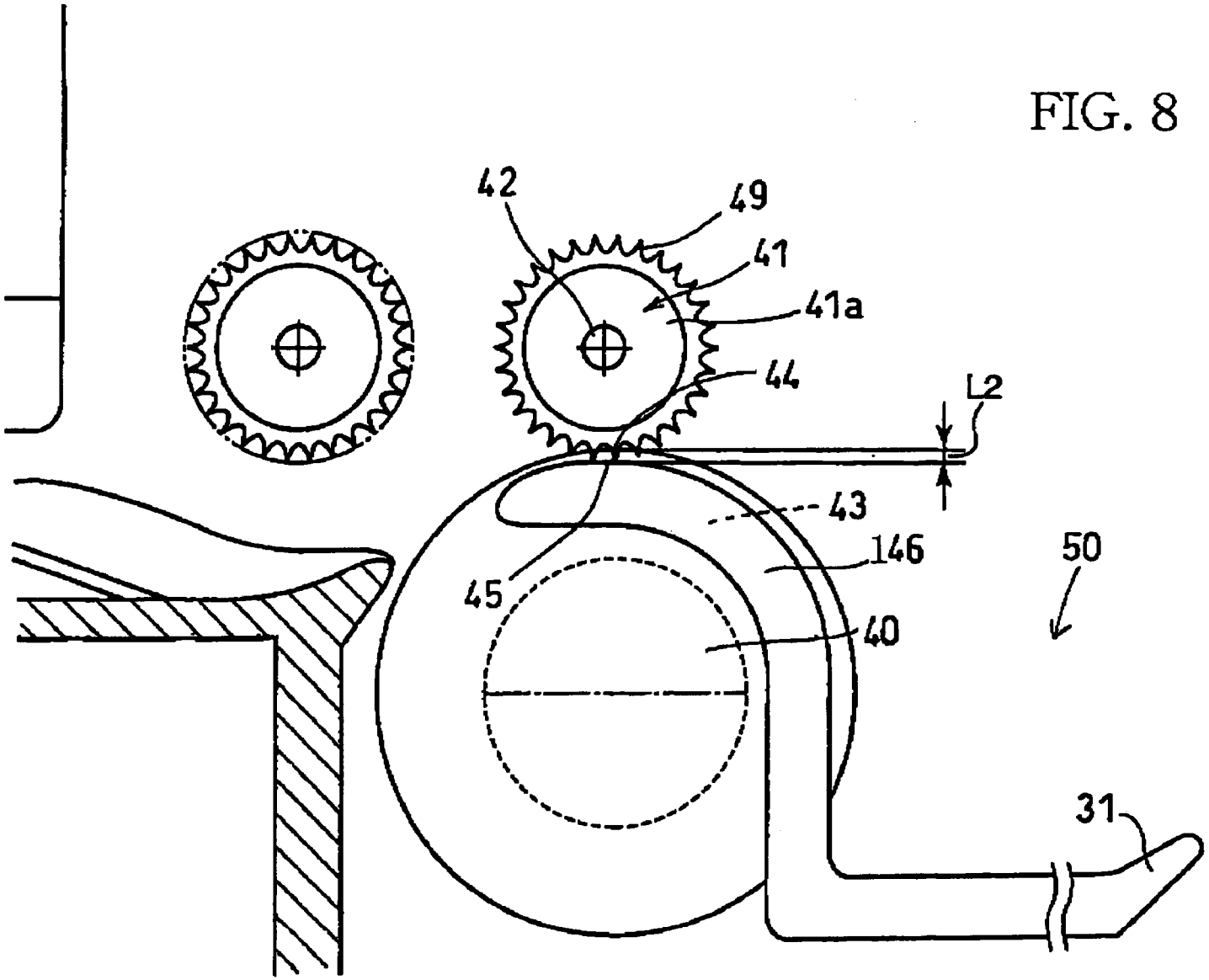
FIG. 8 is a side view of the drive and driven rollers in a modified arrangement.

As described above, in the above-described embodiment, the overlap-amount limiter takes the form of the tongue member 46 which extends in the feed direction of the paper sheet P and which has the distal end portion as the contact portion positioned within each annular groove 43 of the second drive roller 40 and the proximal end portion positioned in a upstream side of the second drive roller 40. However, the overlap-amount limiter may take the form of a tongue member 146 which extends in a direction opposite to the above-described feed direction and which has a proximal end portion positioned in a downstream side of the second drive roller 40, as shown in FIG. 8. The tongue member 146 extends from a member constituting at least a part of the media exit portion 50 which is provided by the media outlet and the media exit tray 31 that is located outside the media outlet. The tongue member 146 may be formed integrally with the above-described member, or may be attached to the above-described member. FIG. 8 illustrates one example of this arrangement in which the tongue member 146 has its proximal end portion provided by the media exit tray 31 that is integrally formed with the tongue member 146. In this arrangement, it is preferable that the tongue member 146 extends in the above-described opposite direction by such a large distance that permits its distal end portion to serve to guide the paper sheet P to the radially outer ends 45 of the driven rollers 41.

Figure 9:
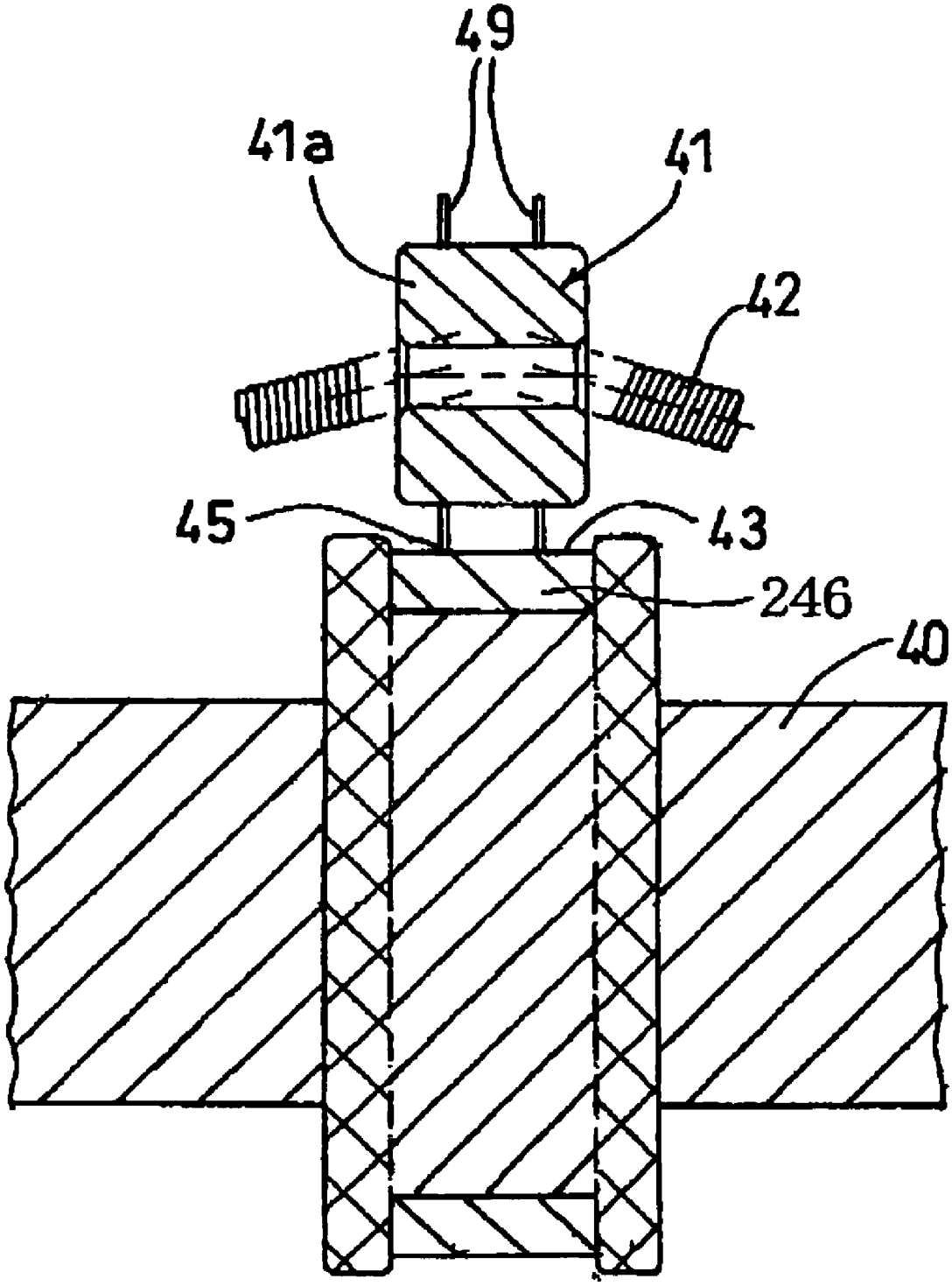
FIG. 9 is a front view of the drive and driven rollers in another modified arrangement.
Figure 10:
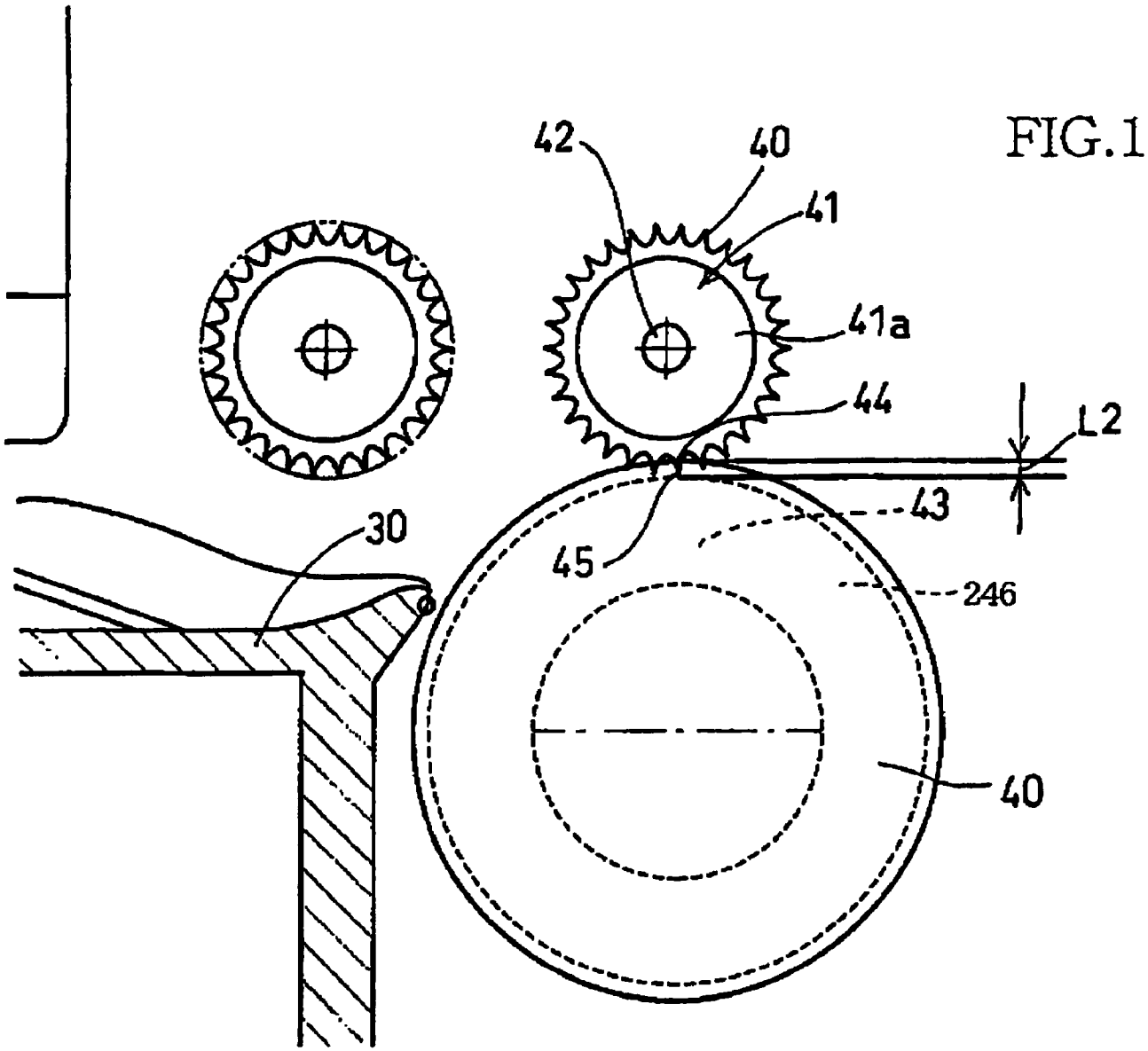
FIG. 10 is a side view of the drive and driven rollers in the above-described another modified arrangement.

Further, the overlap-amount limiter may take the form of an annular member 246 which is accommodated in each annular groove 43 of the second drive roller 40, as shown in FIGS. 9 and 10. A depth of each annular groove 43 is reduced by the provision of the annular member 246 whose outer circumferential surface serves as a contact surface that is to be brought into contact with the radially outer end 45 of the driven roller 41. The annular member 246 serves to limit the overlap amount in the same manner as the above-described tongue members 46, 146.

Figure 12:
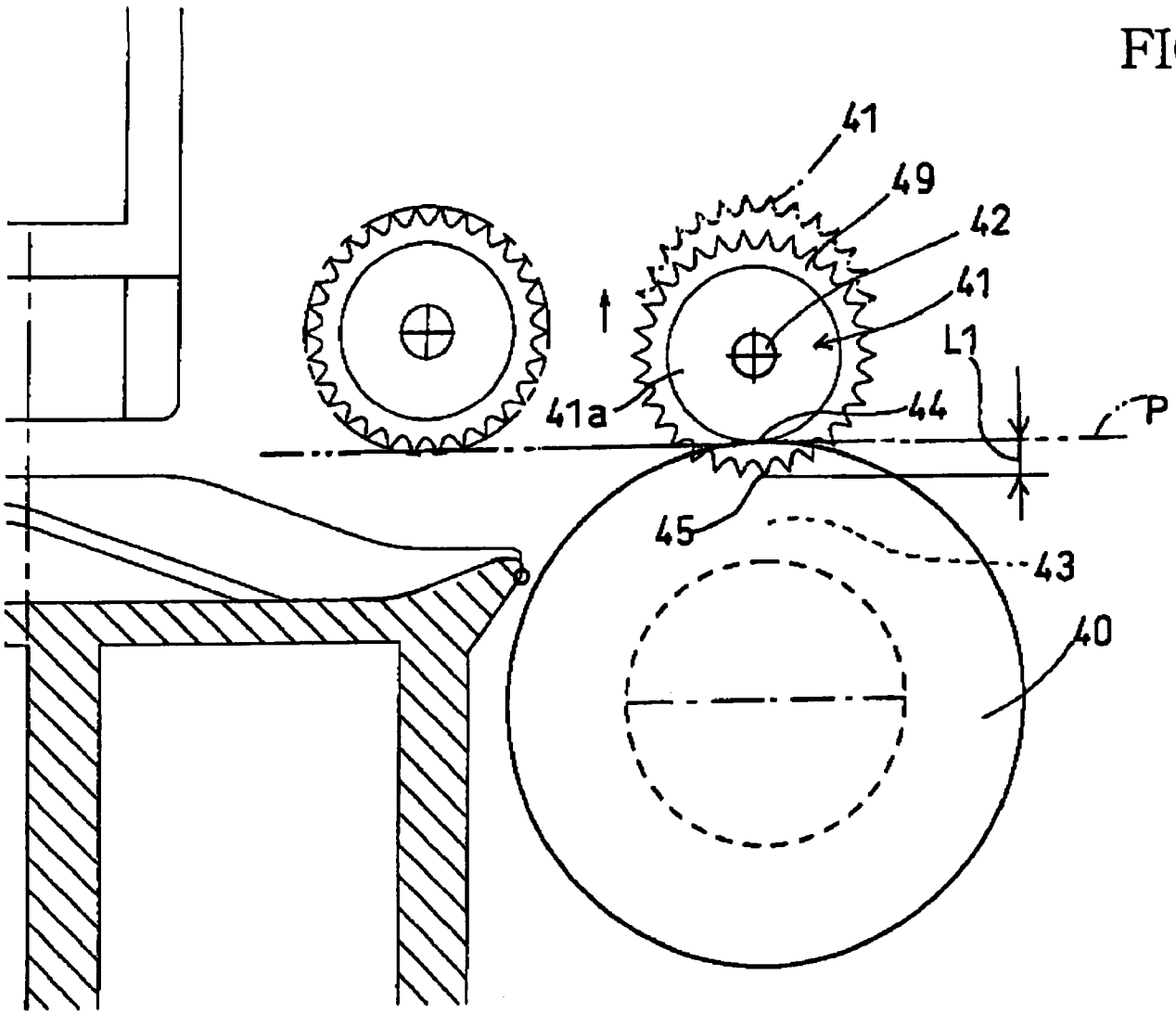
FIG. 12 is a side view of the drive and driven rollers in a conventional feeding device.

The annular member 246 may be formed of rubber, resin or other elastic material and may have a cut portion 248 in its circumferential portion so as to be diametrically expandable. This arrangement makes it possible to fix the annular member 246 in the annular groove 43 of the drive roller 40 even after the drive and driven rollers 40, 41 have been attached to the main body 2, so that the drive and driven rollers 40, 41 can be attached to the main body 2 without the driven rollers 41 being biased by the flexible shafts 42 toward the drive roller 40. Further, this arrangement enables a conventional feeding device as shown in FIG. 12 to be easily modified by simply mounting the annular member 246 onto the drive roller 40. However, this arrangement is not essential. The annular member 246 may be embedded in the bottom surface of the annular groove 43. Further, the annular member 246 does not have to be entirely formed of only the elastic material For example, at least a contact portion of the annular member 246, which portion is brought into contact with the driven roller 41, may be formed of stainless steel, glass or other material harder than the driven roller 41, for enhancing its wear resistance.

While the flexible shafts 42 holding the respective second driven rollers 41 are arranged in series along a straight line in the above-described embodiment, the flexible shafts 42 may be arranged along two or more lines. Further, the driven rollers 41 do not have to be necessarily held independently of each other by respective flexible shafts, but may be commonly held by a single flexible shaft.

While the preferred embodiment of the invention has been described in detail by reference to the accompanying drawings, it is to be understood that the invention is not limited to the details of the illustrated embodiment, but may be embodied with various other changes, modifications and improvements, which may occur to those skilled in the art.

What is claimed is:

1. A feeding device for feeding a recording medium in a feed direction, comprising:

a drive roller having an annular recess formed in an outer circumferential surface thereof;

a driven roller rotatably held and positioned relative to said drive roller such that a radially outer end portion of said driven roller is positioned within said annular recess of said drive roller so that said radially outer end portion of said driven roller overlaps with a radially outer end portion of said drive roller; and a biaser that biases said driven roller toward said drive roller, wherein said driven roller is displaceable at least in a direction away from said drive roller, so that the recording medium is fed to pass between said drive roller and said driven roller, with the recording medium being gripped by said radially outer end portion of said driven roller and said radially outer end portion of said drive roller, said feeding device further comprising:

an overlap-amount limiter that is unmovable by rotation of said drive roller, said overlap-amount limiter including a contact portion which is positioned within said annular recess and which is, during absence of the recording medium between said drive roller and said driven roller, held in contact at a surface thereof with said radially outer end portion of said driven roller, wherein said driven roller is forced in said direction away from said drive roller against a biasing force generated by said biaser, for thereby limiting an overlap amount by which said radially outer end portion of said driven roller overlaps with said radially outer end portion of said drive roller.

2. The feeding device according to claim 1, wherein said biaser includes a flexible shaft holding said driven roller mounted thereon, such that said driven roller is rotatable relative to said flexible shaft.

3. The feeding device according to claim 1, wherein said drive roller is disposed on a downstream side, as viewed in said feed direction, of a recording portion which records an image on the recording medium.

4. The feeding device according to claim 1, wherein said contact portion of said overlap-amount limiter is formed of a material which is harder than a material forming said driven roller.

5. The feeding device according to claim 1, wherein said surface of said contact portion of said overlap-amount limiter is positioned between said outer circumferential surface of said drive roller and a bottom surface of said annular recess of said drive roller.

6. The feeding device according to claim 1, wherein said driven roller is formed of a resin.

7. An image recording apparatus comprising:

the feeding device defined in claim 1;

a recording portion which records an image on a recording medium and which is disposed on an upstream side of said feeding device as viewed in said feed direction;

a platen which is opposed to said recording portion and supports the recording medium; and a media exit portion through which the recording medium exits from said apparatus after the image is recorded on the recording medium by said recording portion.

8. The image recording apparatus according to claim 7, wherein said overlap-amount limiter includes a tongue member which extends in said feed direction and which has a proximal end portion positioned on an upstream side of said driven roller as viewed in said feed direction.

9. The image recording apparatus according to claim 8, wherein said tongue member extends from said platen.

10. The image recording apparatus according to claim 9, wherein said tongue member is formed integrally with said platen.

11. The image recording apparatus according to claim 7, wherein said overlap-amount limiter includes a tongue member which extends in a direction opposite to said feed direction and which has a proximal end portion positioned on a downstream side of said driven roller as viewed in said feed direction.

12. The image recording apparatus according to claim 11, wherein said tongue member extends from a member which constitutes at least a part of said media exit portion.

13. The image recording apparatus according to claim 12, wherein said tongue member is formed integrally with said member which constitutes at least the part of said media exit portion.

14. The image recording apparatus according to claim 12, wherein said member which constitutes at least the part of said media exit portion is provided by a media exit tray which supports the recording medium after the image is recorded on the recording medium by said recording portion.

15. The feeding device according to claim 1, wherein said driven roller includes a toothed radially outer end portion which has a plurality of radially-extending projections.

16. The feeding device according to claim 1, wherein said overlap-amount limiter is provided by a member that is separated by said drive roller.

17. A feeding device for feeding a recording medium in a feed direction, comprising:

a drive roller having a plurality of annular recesses formed in an outer circumferential surface thereof;

a plurality of driven rollers positioned relative to said drive roller such that a radially outer end portion of each of said driven rollers is positioned within a corresponding one of said annular recesses of said drive roller so that said radially outer end portion of each of said driven rollers overlaps with a radially outer end portion of said drive roller; and a plurality of flexible shafts each holding a corresponding one of said driven rollers mounted on an axially intermediate portion thereof:, such that the corresponding one of said driven rollers is rotatable relative to each of said flexible shafts, each of said flexible shafts serving as a biaser that biases the corresponding one of said driven rollers toward said drive roller, wherein each of said driven rollers is displaceable at least in a direction away from said drive roller, so that the recording medium is fed to pass between said drive roller and said driven rollers, with the recording medium being gripped by said radially outer end portion of each of said driven rollers and said radially outer end portion of said drive roller, said feeding device further comprising:

a plurality of overlap-amount limiters each unmovable by rotation of said drive roller, each of said overlap-amount limiters including a contact portion which is positioned within a corresponding one of said annular recesses and which is, during absence of the recording medium between said drive roller and said driven rollers, held in contact at a surface thereof with said radially outer end portion of a corresponding one of said driven rollers, wherein each of said driven rollers is forced in said direction away from said drive roller against a biasing force generated by said biaser, for thereby limiting an overlap amount by which said radially outer end portion of each of said driven rollers overlaps with said radially outer end portion of said drive roller.

18. The feeding device according to claim 17, further comprising a displacement limiter which limits displacement of axially opposite end portions of each of said flexible shafts in the direction away from said drive roller.

* * * * *